US009574555B2

(12) United States Patent
Tung

(10) Patent No.: US 9,574,555 B2
(45) Date of Patent: Feb. 21, 2017

(54) MINIATURE AIR PUMP

(71) Applicant: XIAMEN KOGE MICRO TECH CO., LTD., Fujian (CN)

(72) Inventor: Cheng-Kai Tung, New Taipei (TW)

(73) Assignee: XIAMEN KOGE MICRO TECH CO., LTD., Fujian (CN)

( * ) Notice: Subject to any disclaimer, the term of this patent is extended or adjusted under 35 U.S.C. 154(b) by 314 days.

(21) Appl. No.: 14/061,764

(22) Filed: Oct. 24, 2013

(65) Prior Publication Data

US 2014/0119959 A1 May 1, 2014

(30) Foreign Application Priority Data

Oct. 26, 2012 (TW) ..... 101139844 A

(51) Int. Cl.
*F04B 27/08* (2006.01)
*F04B 43/02* (2006.01)
*F04B 43/00* (2006.01)

(52) U.S. Cl.
CPC ..... *F04B 27/0882* (2013.01); *F04B 43/0045* (2013.01); *F04B 43/021* (2013.01)

(58) Field of Classification Search
CPC ... F04B 27/08; F04B 27/0878; F04B 27/0882; F04B 1/12; F04B 1/124; F04B 1/126; F04B 1/14; F04B 43/0045
USPC ..... 417/412, 413.1, 480; 403/221, 222, 223, 403/240, 242, 263, 297
See application file for complete search history.

(56) References Cited

U.S. PATENT DOCUMENTS 3,364,870 A * 1/1968 Quatredeniers ..... F02M 1/00 417/413.1
2003/0031571 A1* 2/2003 Yamakawa ..... F04B 43/0045 417/412
2005/0196302 A1* 9/2005 Huang ..... F04B 43/026 417/412
2006/0025693 A1* 2/2006 Sano ..... A61B 5/02141 600/490

FOREIGN PATENT DOCUMENTS

CN 1854514 11/2006
CN 1288344 C 12/2006
CN 102536736 7/2012
CN 202483831 U 10/2012
(Continued)

*Primary Examiner* — Devon Kramer
*Assistant Examiner* — Kenneth J Hansen
(74) *Attorney, Agent, or Firm* — CKC & Partners Co., Ltd.

(57) ABSTRACT

A miniature air pump includes a motor unit, a valve unit and a compression unit. The compression unit is driven by the motor unit to input or output airflows via the valve unit. The compression unit includes an air chamber module and a linkage rod. The air chamber module includes a plurality of compressible chambers and a plurality of resilient connection members, each resilient connection member is located on each compressible chamber. The linkage rod is connected with the motor unit and includes a central rod and multiple sleeves extending from the central rod. Each sleeve has a side cutout. Each resilient connection members engages each sleeve via the side cutout such that the motor unit drives the air chamber module to be compressed or decompressed to input or output airflows via the valve unit. A longitudinal direction of the side cutout is in parallel with the central rod.

6 Claims, 11 Drawing Sheets

(56) References Cited

FOREIGN PATENT DOCUMENTS

| | | | | | |
|---|---|---|---|---|---|
| CN | 202483847 | U | | 10/2012 | |
| CN | 202493407 | U | | 10/2012 | |
| DE | 102006061760 | A1 | * | 4/2008 | ..... F04B 39/10 |
| EP | 1052407 | A2 | | 11/2000 | |
| TW | 448981 | | | 8/2001 | |

* cited by examiner

MINIATURE AIR PUMP

RELATED APPLICATIONS

This application claims priority to Taiwan Application Serial Number 101139844, filed Oct. 26, 2012, which is herein incorporated by reference.

BACKGROUND

Field of Invention

The present invention relates to a pump. More particularly, the present invention relates to a miniature air pump.

Description of Related Art

A miniature pump is a smaller size pump. Because the miniature pump's volume is reduced, only a motor of a lower power can be installed in the miniature pump. Therefore, the efficiency of miniature pump depends on its valve or chamber design.

FIG. 1 illustrates a cross-sectional view of a conventional miniature pump. A conventional miniature pump 100 includes a motor unit 110, a valve unit 120, two chamber units 130/130' and a linkage rod 140. An eccentric shaft portion 112 is coupled with the motor unit 110, and the linkage rod 140 is inserted into an eccentric hole 112*a* of the eccentric shall portion 112. The two chamber units 130/130' have their bottom ends fastened to the linkage rod 140 and being compressed or decompressed by the linkage rod 140, which rotates eccentrically, thereby enabling airflows to be input or output via the valve unit 120.

Because the chamber units 130/130' within the conventional miniature pump are made from elastic rubber materials and the two chamber units 130/130' have their bottom ends fastened to the linkage rod 140 directly, the two chamber units 130/130' may not be compressed or decompressed by the linkage rod 140 efficiently and the bottom ends of the two chamber units 130/130' may sometimes be pulled off from the linkage rod 140 to result in malfunction of the miniature pump.

SUMMARY

It is therefore an objective of the present invention to provide an miniature air pump to deal with the problems as discussed in the prior art.

In accordance with the foregoing and other objectives of the present invention, a miniature air pump includes a motor unit, a valve unit and a compression unit. The compression unit is connected with the motor unit and driven by the motor unit to input or output airflows via the valve unit. The compression unit includes an air chamber module and a linkage rod. The air chamber module includes a plurality of compressible chambers and a plurality of resilient connection members, each resilient connection member is located on each compressible chamber. The linkage rod is connected with the motor unit and includes a central rod and multiple sleeves extending from the central rod. Each sleeve has a side cutout. Each resilient connection members engages each sleeve via the side cutout such that the motor unit drives the air chamber module to be compressed or decompressed so as to input or output airflows via the valve unit, wherein a longitudinal direction of the side cutout is in parallel with the central rod.

According to another embodiment disclosed herein, the motor unit includes an eccentric shaft portion having an eccentric hole into which the central rod is inserted.

According to another embodiment disclosed herein, the air chamber module further includes a chamber base to secure the compressible chambers, the chamber base has a central groove into which a first bearing ball and a top end of the central rod are located.

According to another embodiment disclosed herein, the eccentric hole of the eccentric shaft portion has a second bearing ball with which a bottom end of the central rod is in contact.

According to another embodiment disclosed herein, each compressible chamber and each resilient connection member are made of a single material member.

According to another embodiment disclosed herein, each compressible chamber and each resilient connection member are made of different materials, and each resilient connection member has a greater hardness than each compressible chamber.

According to another embodiment disclosed herein, each compressible chamber and each resilient connection member are made of different materials, and each compressible chamber has a bottom through hole into which a sealing head of each resilient connection member engages.

According to another embodiment disclosed herein, each compressible chamber has a convex sealing ring disposed around the bottom through hole to be in contact with the sealing head of each resilient connection member.

According to another embodiment disclosed herein, each resilient connection member has a bottom head to be engaged by each sleeve of the linkage rod.

According to another embodiment disclosed herein, a maximum outer diameter of the bottom head is greater than a maximum inner diameter of each sleeve.

According to another embodiment disclosed herein, a maximum outer diameter of the sealing head is greater than the maximum outer diameter of the bottom head.

Thus, a miniature pump of the present invention has its compressible chamber and resilient connection member made from different materials, and the resilient connection member is made from harder materials. Therefore, when the resilient connection member is coupled with the linkage rod, the resilient connection member is able to compress or decompress the compressible chamber efficiently. The first, second bearing balls are located at two opposite ends of the central rod of the linkage rod to secure the linkage rod stably within the miniature pump, thereby reducing the noises and friction caused by the rotating linkage rod.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
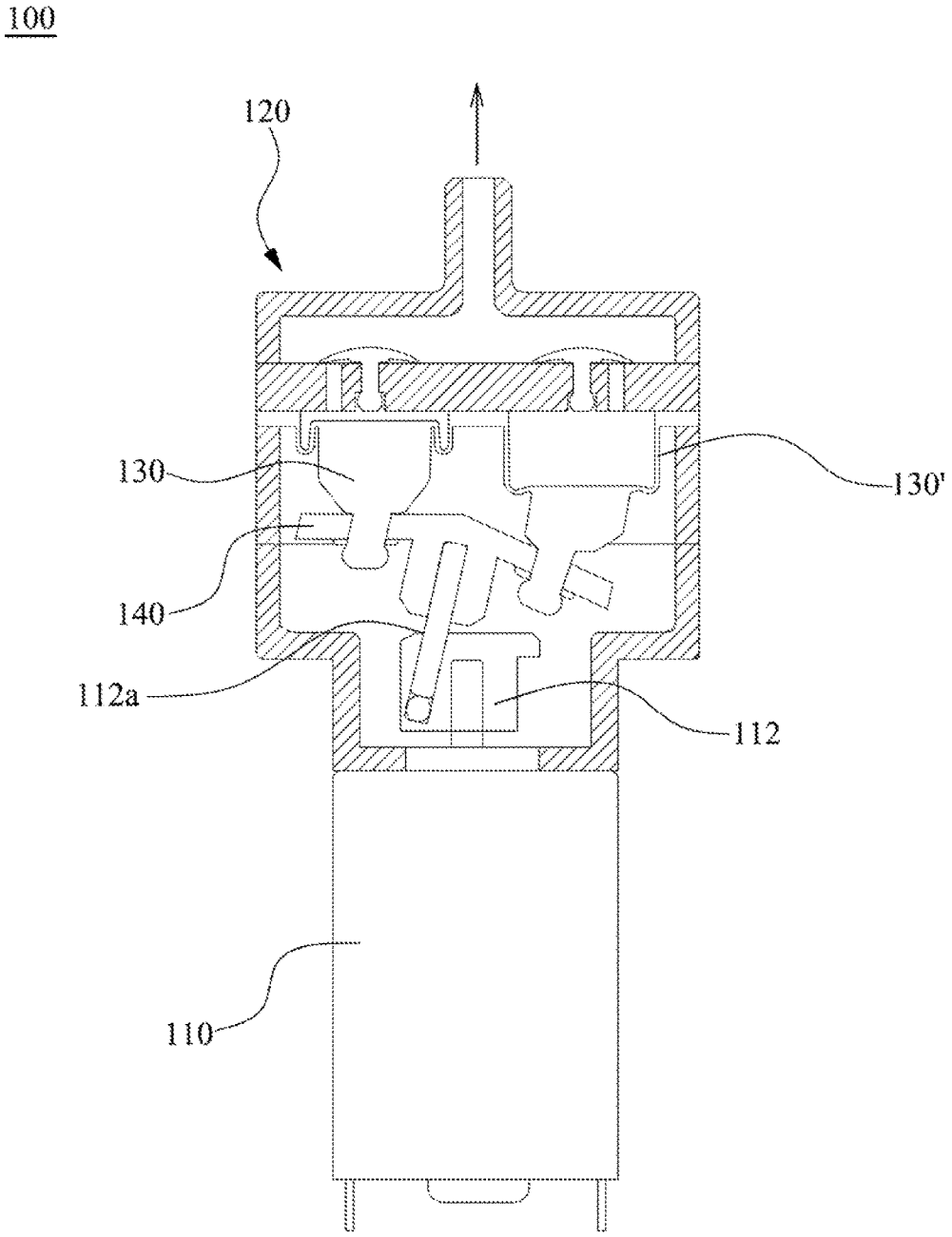
Fig. 1 (PRIOR ART)
FIG. 1 illustrates a cross-sectional view of a conventional miniature pump.

Reference will now be made in detail to the present embodiments of the invention, examples of which are illustrated in the accompanying drawings. Wherever possible, the same reference numbers are used in the drawings and the description to refer to the same or like parts.

Figure 2:
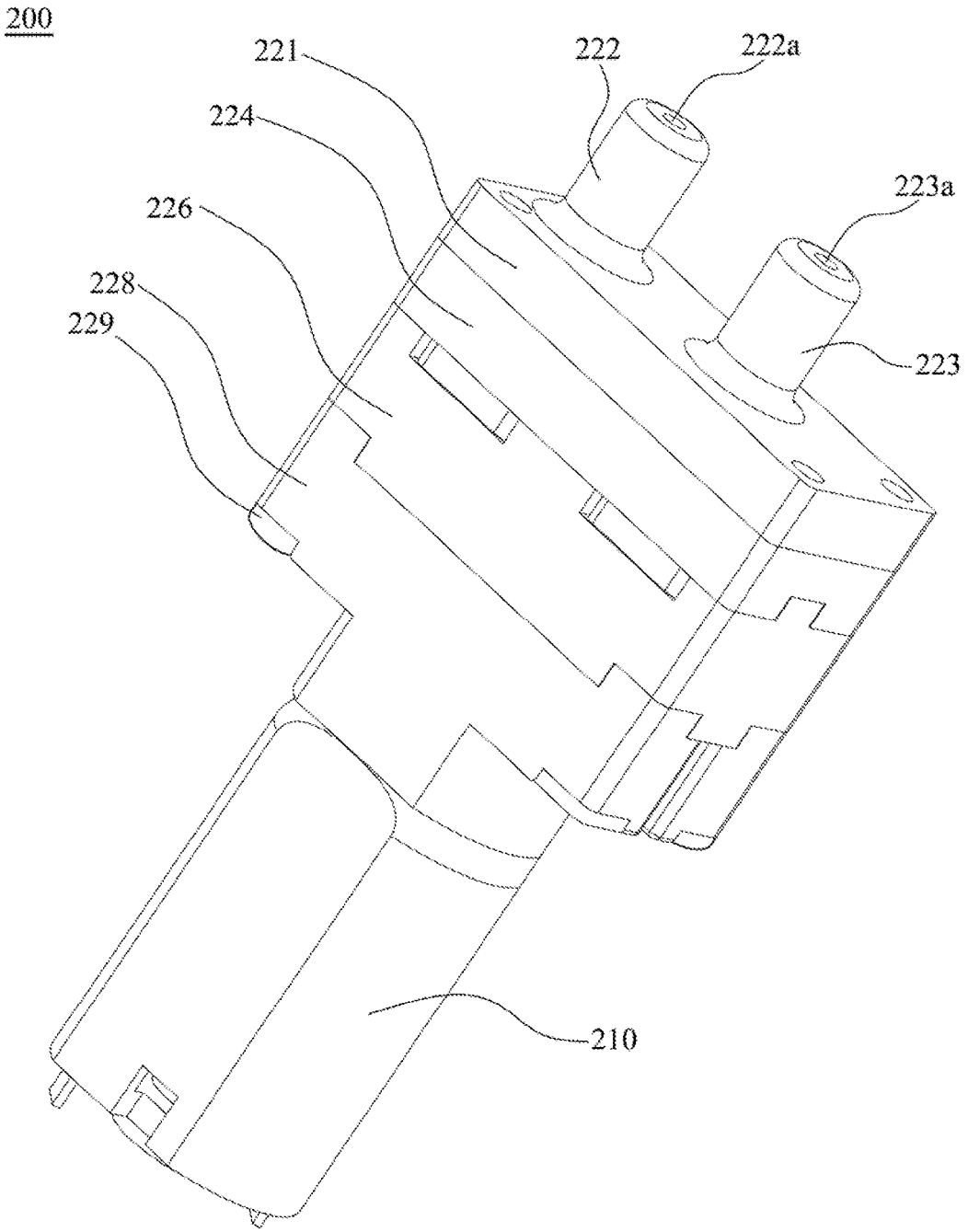
FIG. 2 illustrates a perspective view of a miniature pump according to one embodiment of this invention.
Figure 3:
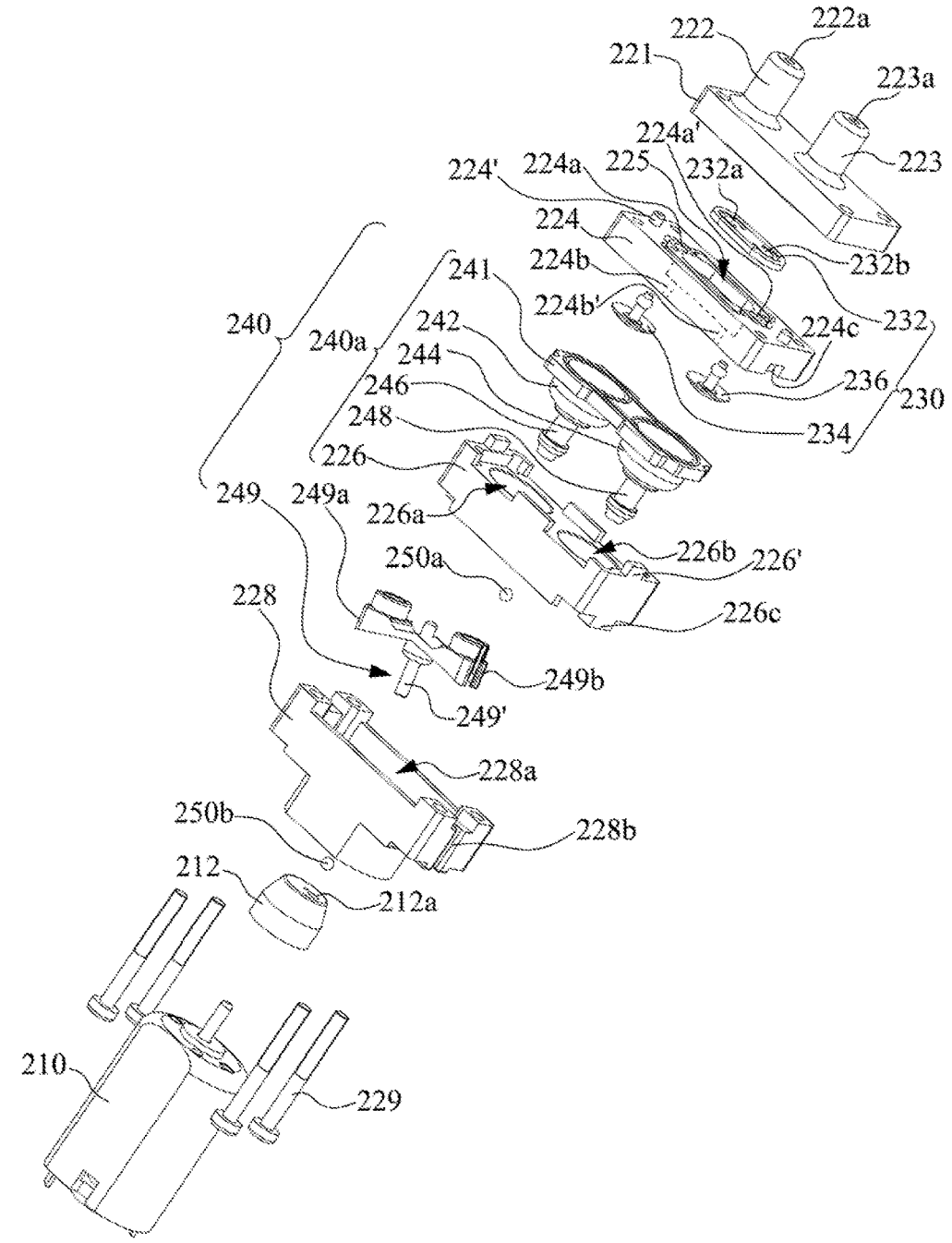
FIG. 3 illustrates an exploded view of the miniature pump in FIG. 2.

Referring to FIG. 2 and FIG. 3, FIG. 2 illustrates a perspective view of a miniature pump 200 according to one embodiment of this invention, and FIG. 3 illustrates an exploded view of the miniature pump 200 in FIG. 2. The miniature pump 200 includes an upper cover 221, a valve base 224, a chamber base 226 and a motor base 228 that are assembled together to enclose a valve unit 230, a compression unit 240 and a motor unit 210. In this embodiment, bolts 229 are used to insert via through holes of the motor base 228, the upper cover 221, the valve base 224 and the chamber base 226 to secure them all. In addition, an ultrasonic welding may he applied to the upper cover 221, the valve base 224, the chamber base 226 and the motor base 228 to fasten them stably.

In addition, the compression unit 240 is connected with the motor unit 210, which drives the compression unit 240 to alternately input or output airflows via the valve unit 230.

The upper cover 221 has an output port 223 and an input port 222 on its upper surface. The output port 223 has an output through hole 223*a* at its central position while the input port 222 has an input through hole 222*a* at its central position. Airflows are introduced into the miniature pump 200 via the input through hole 222*a* of the input port 222 and then output via the output through hole 223*a* of the output port 223. The upper cover 221 is secured to an upper surface of the valve base 224, In addition, the valve base 224 may have two position pins 224' to previously guide the upper cover 221 in proper position before the bolts are used to secure them.

After the upper cover 221 and the valve base 224 are assembled, an input passage 224*a*/224*a*' and an output passage 224*b*/224*b*' within the valve base 224 are connected with the input port 222 and output port 223 of the upper cover 221 respectively such that airflows can be introduced via the input port 222 and the input passage 224*a*/224*a*' and then output via the output passage 224*b*/224*b*' and the output port 223.

A one-way valve 232 is installed on a valve region 225 of the valve base 224 so as to control airflows through the valve base 224 in a predetermined direction. When the miniature pump 200 does not operate, a valve gate 232*a* of the one-way valve 232 blocks an opening of the output passage 224*b*, and a valve gate 232*b* blocks an opening of the output passage 224*b*'. When the airflows tend to flow out of the opening of the output passage 224*b*, the valve gate 232*a* is opened (i.e., rises up) and the valve gate 232*b* is kept closed. Therefore, the airflows can flow out of the opening of the output passage 224*b* but will not flow into the output passage 224*b*' due to the closed valve gate 232*b*. Similarly, when the airflows tends to flow out of the opening of the output passage 224*b*', the valve gate 232*b* is opened (i.e., rises up) and the valve gate 232*a* is kept closed. Therefore, the airflows can flow out of the opening of the output passage 224*b*' but will not flow into the output passage 224*b* due to the closed valve gate 232*a*. A bottom side of the valve base 224 is connected to several chamber valves 234/236 to control airflows to be input into or output from the compressible chambers 242/244. In this embodiment, the chamber valves 234/236 are one-way umbrella-shaped valves, which only allow airflows in single direction.

Therefore, the valve unit 230 consisting of the one-way valve 232 and the chamber valves 234/236 is able to guide airflows introduced via the input port 222 or exhausted out via the output port 223. In this embodiment, the one-way valve 232 and the chamber valves 234/236 are both elastic rubber material valves. In other embodiments, the one-way valve 232 and the chamber valves 234/236 may be made from materials other than rubber materials.

In addition, a bottom portion of the valve base 224 is assembled to the chamber base 226 of the air chamber module 240*a*. For example, the chamber base 226 has two listeners 226 clamp two side grooves 224*c* of the valve base 224 respectively. The air chamber module 240*a* has a plurality of compressible chambers 242/244 and a plurality of resilient connection members 246/248, each resilient connection member 246/248 is located at a bottom end of each compressible chamber 242/244. The air chamber module 240*a* may further include a chamber base 226 to secure the compressible chambers 242/244. For example, a plurality of compressible chambers 242/244 are combined by a link member 241 and assembled into two receiving holes 226*a*/226*b* of the chamber base 226 respectively.

After the valve base 224 is assembled to the chamber base 226, the compressible chambers 242/244 has their top portions connected with the chamber valves 234/236. The chamber valves 234/236 are attached upon a top surface of the compressible chambers 242/244 such that the chamber valves 234/236 control input or output of airflows when the compressible chambers 242/244 are being compressed or decompressed.

The resilient connection members 246/248 extend from a bottom end of the compressible chambers 242/244 respectively. In this embodiment, the compressible chambers 242/244 and the resilient connection member 246/248 are made of a simile material member (i.e., are made of the same material). In other embodiment, the compressible chambers 242/244 and the resilient connection members 246/248 are made of a single integrated member but of different materials, and the resilient connection members 246/248 have a greater hardness than the compressible chambers 242/244.

The resilient connection members 246/248 are coupled with the sleeves 249*a*/249*b*, which extends from a central rod 249', respectively such that the compressible chambers 242/244 and the linkage rod 249 can collectively form an important part of the compression unit 240. The central rod 249' of the linkage rod. 249 has its bottom end inserted into an eccentric hole 212*a* of an eccentric shaft portion 212, which is driven to rotate by the motor unit 210. The linkage rod 249 and the eccentric shaft portion 212 are located within a hollow chamber 228*a* of the motor base 228. The motor base 228 has its top portion fastened with a bottom portion of the chamber base 226. For example, the chamber base 226 has two fasteners 226*c* that are assemble to two groves 228*b* of the motor base 228.

After the linkage rod 249 and the resilient connection members 246/248 are connected, the eccentric shaft portion 212, which is driven to rotate by the motor unit 210, is able to drive the linkage rod 249 to rotate, thereby moving the resilient connection members 246/248 up and down so as to compress or decompress the compressible chambers 242/244 respectively.

In this embodiment, the compressible chambers 242/244 are made of elastic rubber materials while the resilient connection members 246/248 are made of elastic rubber materials or harder plastic materials (compared with rubber materials). In other embodiments, the resilient connection members 246/248 may be made of other harder plastic materials. The harder resilient connection members 246/248 are able to compress or decompress the compressible chambers 242/244 respectively to drive airflows through the valve unit 230 efficiently.

In this embodiment, the chamber base 226 has a first bearing ball 250*a* located within its central groove 226*d* to secure the linkage rod 249 to be rotated stably, thereby reducing the noises caused by the rotating linkage rod 249 in this embodiment, the first bearing ball 250*a* is a steel ball. In other embodiments, the first hearing ball 250*a* may be made of other harder materials.

In addition, the eccentric hole 212*a* of the eccentric shaft portion 212 may have a second bearing ball 250*b* inside to be in contact with a bottom end of the central rod 249' of the linkage rod 249. Therefore, when the eccentric shaft portion 212 is driven by the motor unit 210 to rotate, the linkage rod 249 is able to rotate smoothly together with the eccentric shaft portion 212. The second bearing ball 250*b* also reduces the friction between the central rod 249' and the eccentric shaft portion 212. In this embodiment, the second bearing ball 250*b* is a steel ball. In other embodiments, the second bearing ball 250*b* may be made of other harder materials.

Figure 4:
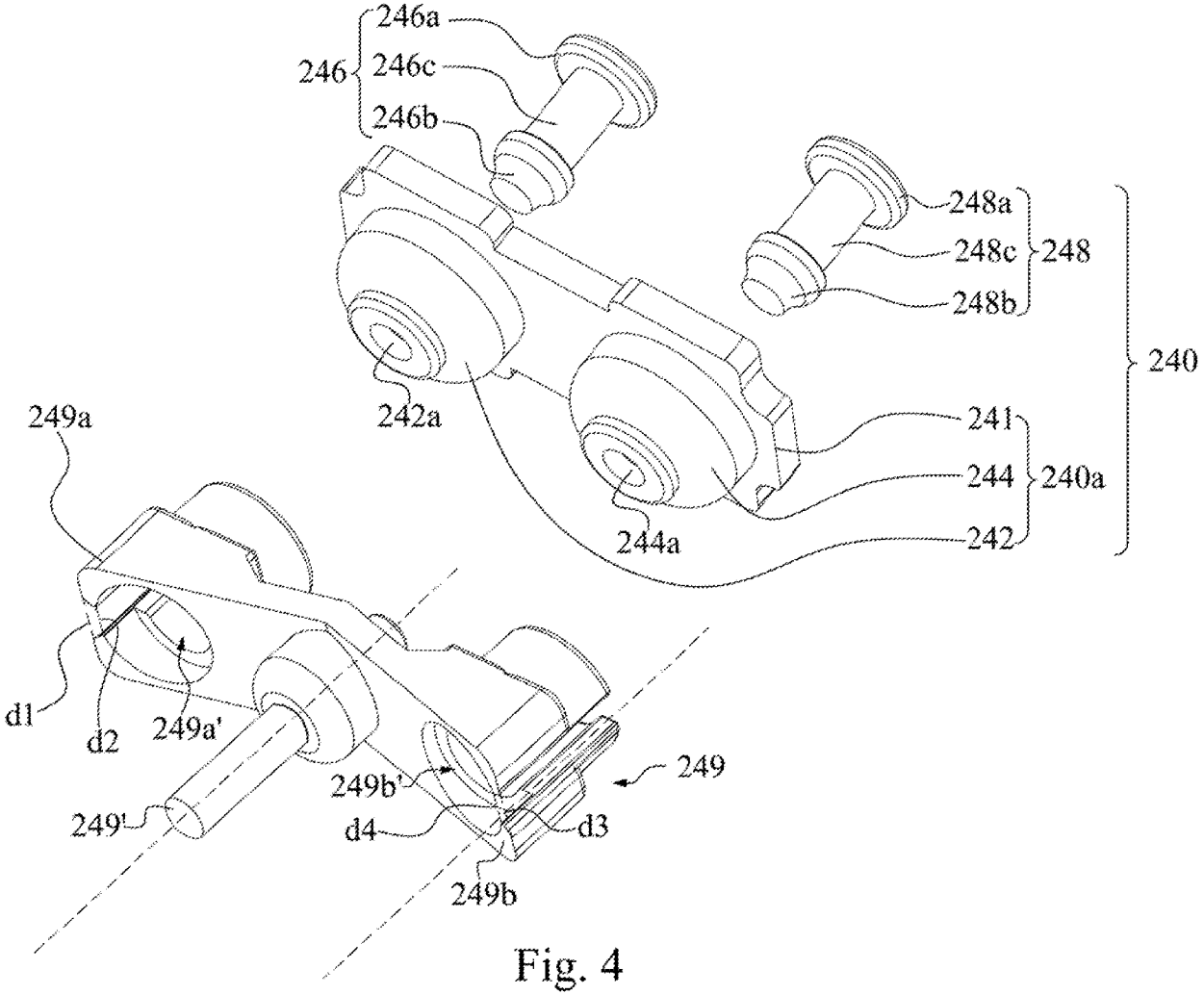
FIG. 4 illustrates an exploded view of a compression unit of a miniature pump according to another embodiment of this invention.
Figure 5:
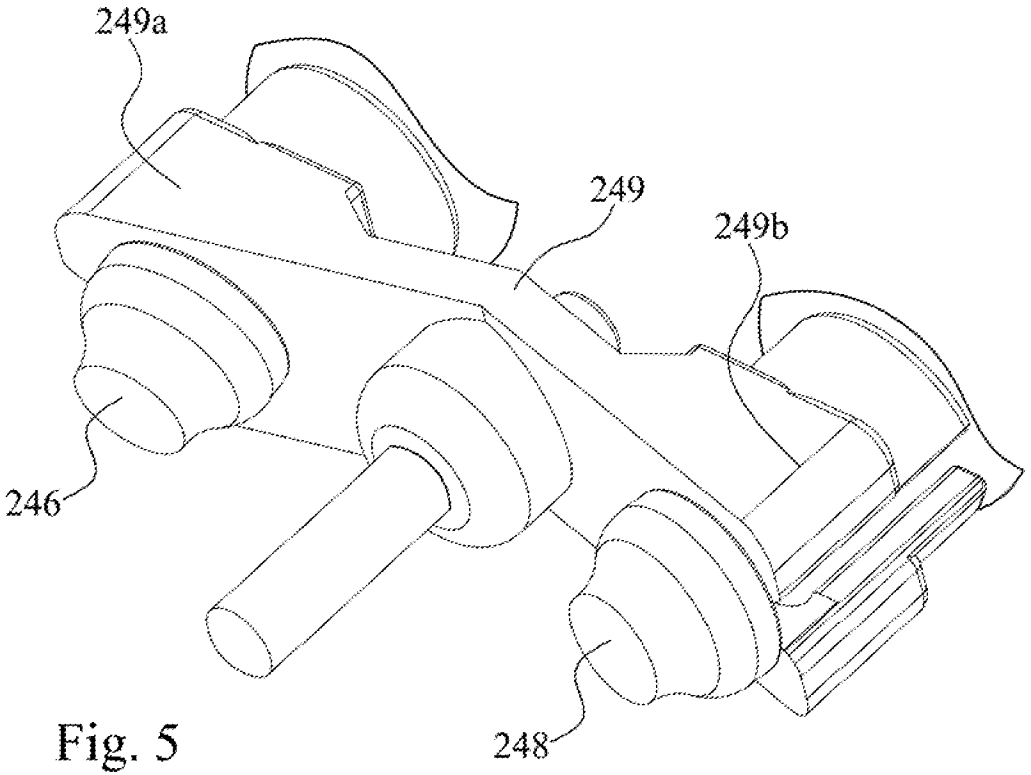
FIG. 5 illustrates an assembled view of the compression unit in FIG. 4.

Referring to both FIG. 4 and FIG. 5, FIG. 4 illustrates an exploded view of a compression unit of a miniature pump according to another embodiment of this invention, and FIG. 5 illustrates an assembled view of the compression unit in FIG. 4. In this embodiment, the compressible chambers 242/244 and the resilient connection. members 246/248 are made of different materials and assembled as one piece.

Referring to both FIG. 4 and FIG. 5, the resilient connection member 246/248 includes a rod portion 246*c*/248*c*, a sealing head 246*a*/248*a* and a bottom head 246*b*/248*b*. In this embodiment. the sealing head 246*a*/248*a* is a circular disk while the bottom head 246*b*/248*b* is a circular cone, and a maximum outer diameter of the sealing head 246*a*/248*a* is greater than a maximum outer diameter of the bottom head 246*b*/248*b*.

Because the compressible chambers 242/244 are made from elastic rubber materials, the bottom heads 246*b*/248*b* of the resilient connection members 246/248 may be led through the bottom through holes 242*a*/244*a* of the compressible chambers 242/244. In addition, because a maximum outer diameter of the sealing heads 246*a*/248*a* is greater than a maximum inner diameter of the bottom through hole 242*a*/244*a* such that the sealing heads 246*a*/248*a* tend to be in contact with an inner wall around the bottom through holes 242*a*/244*a* of the compressible chambers 242/244.

After the resilient connection members 246/248 are coupled with the compressible chambers 242/244, the rod portion 246*c*/248*c* of the resilient connection member 246/248 are engaged by the sleeves 249*a*/249*b* of the linkage rod 249 through the side cutout. A longitudinal direction of the side cutouts of the sleeves 249*a*/249*b* is in parallel with the central rod 249 of the linkage rod 249.

Because the maximum outer diameters of the sealing heads 246*a*/248*a* and the bottom heads 246*b*/248*b* are all greater than a maximum inner diameter of sleeves 249*a*/249, and the rod portions 246*c*/248*c* and the sleeves 249*a*/249*b* are equal in their length, the resilient connection members 246/248 fit well into internal circular grooves 249*a*'/249*b*' of the sleeve 249*a*/249*b*.

In this embodiment, a maximum outer diameter of the bottom heads 246*b*/248*b* is greater than a maximum inner diameter of the internal circular grooves 249*a*'/249*b*' of the sleeves 249*a*/249*b*.

in this embodiment, the side cutouts of the sleeve 249*a*/249*b* have a pair of inclined surfaces, an outer minimum distance d1/d3 of the side cutouts of the sleeves 249*a*/249*b* is greater than an inner minimum distance d2/d4 of the side cutouts of the sleeves 249*a*/249*b*. The side cutouts of the sleeves 249*a*/249*b* have the pair of inclined surfaces for the resilient connection members 246/248 to be easily slid into the internal circular grooves 249*a*'/249*b*' of the sleeves 249*a*/249*b*.

Figure 6:
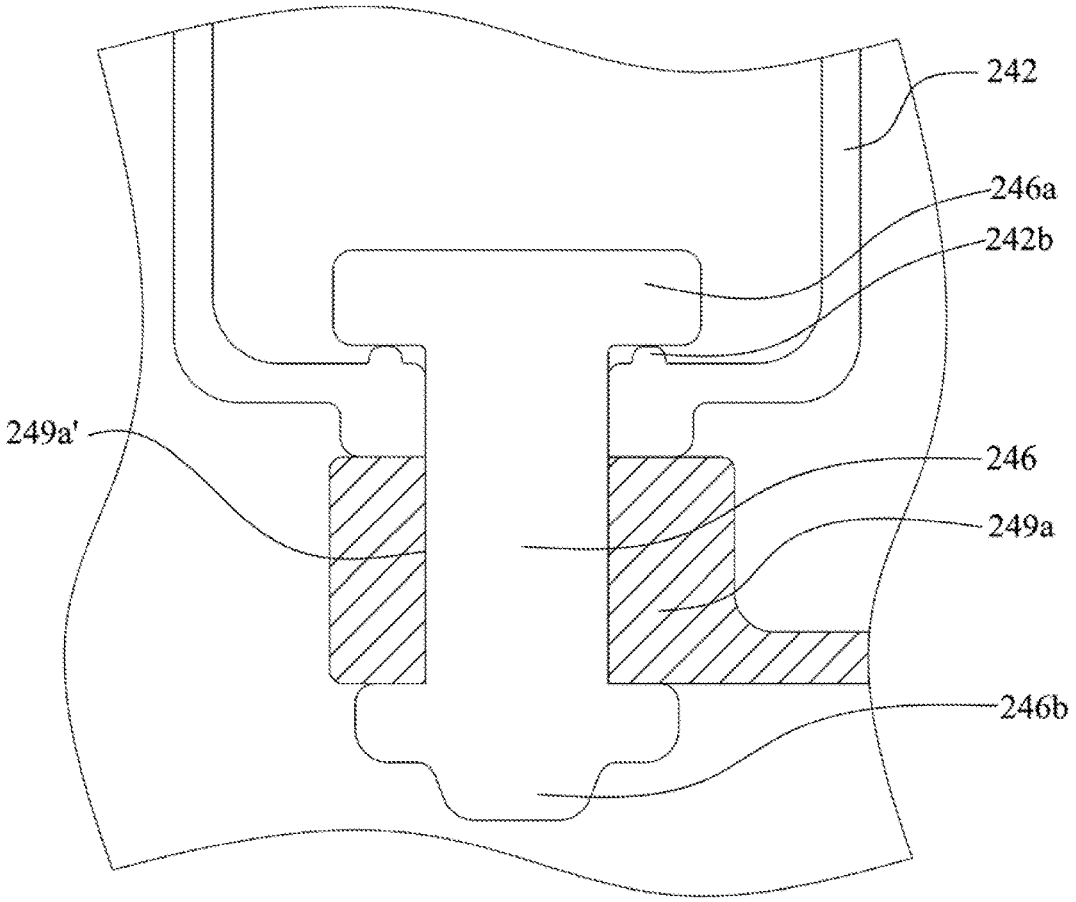
FIGS. 6 & 7 illustrates two cross-sectional views of the compression unit in FIG. 5.
Figure 7:
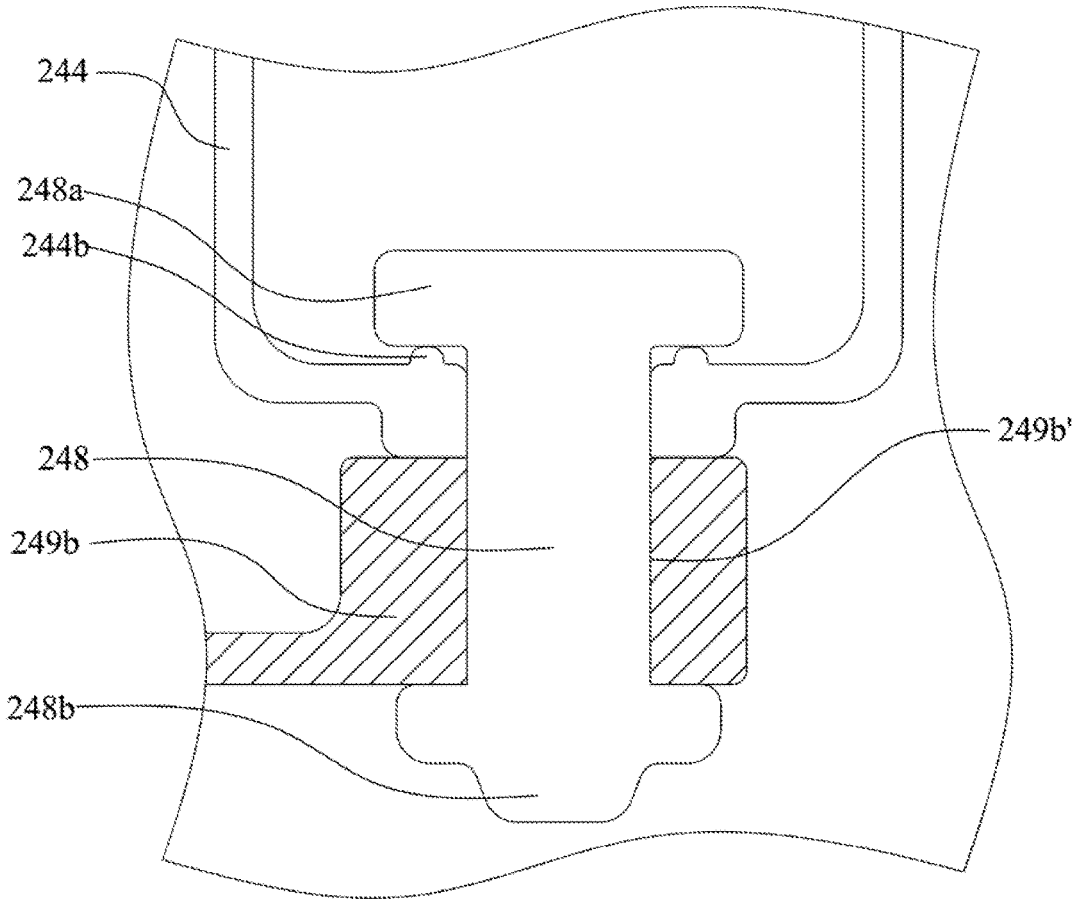

Referring to FIG. 5, FIG. 6 and FIG. 7, FIGS. 6 & 7 illustrates two cross-sectional views of the compression unit in FIG. 5. After the resilient connection members 246/248 are coupled with the compressible chambers 242/244 and the sleeves 249*a*/249*b*, the sealing heads 246*a*/248*a* of the resilient connection members 246/248 are in contact with an inner wall of the compressible chambers 242/244, and the sleeves 249*a*/249*b* fit between the sealing heads 246*a*/248*a* and the bottom heads 246*b*/248*b*. In this embodiment, the compressible chambers 242/244 have a convex sealing ring 242*b*/244*b* around the bottom through hole to be in contact with the sealing head 246*a*/248*a* of the resilient connection member 246/248. The convex sealing rings 242*b*/244*b* are used to prevent airflow leakage via the bottom through. holes 242*a*/244*a* of the compressible chambers 242/244. In this embodiment, the compressible chambers 242/244 and its convex sealing rings. 242*b*/244*b* are all made from elastic rubber materials.

Figure 8:
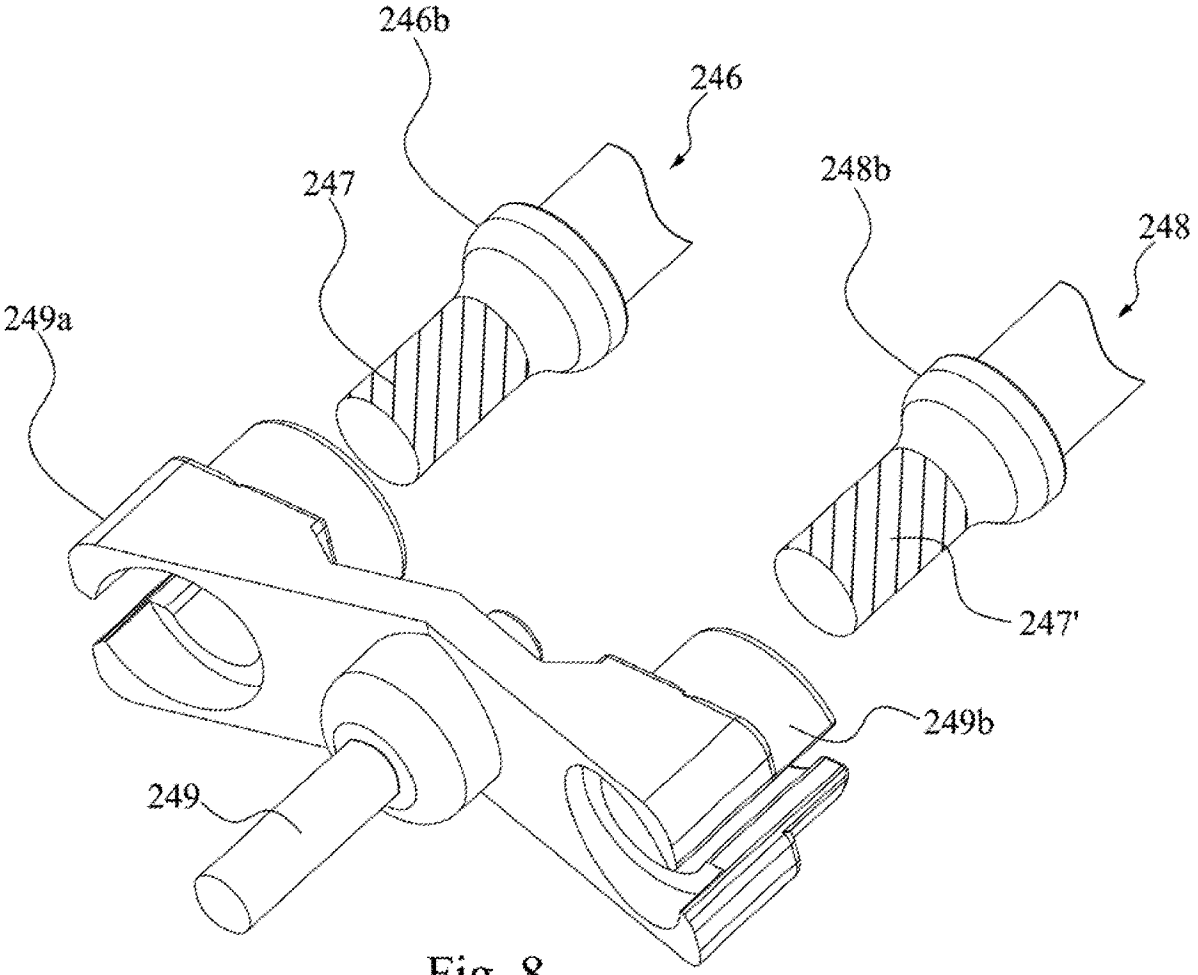
FIG. 8 illustrates a perspective, view of the linkage rod and the resilient connection member in FIG. 2 before assembly.
Figure 9:
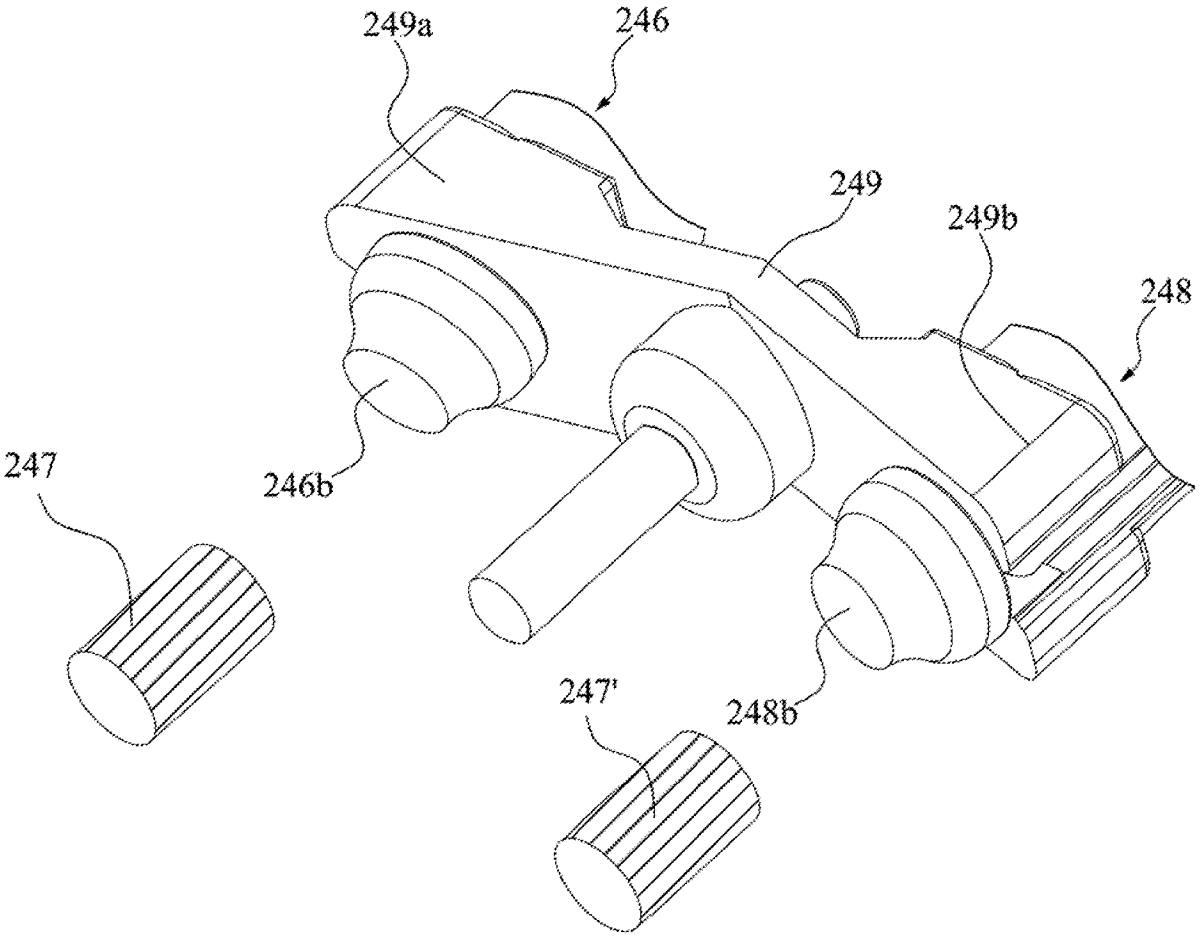
FIG. 9 illustrates a perspective view of the linkage rod and the resilient connection member in FIG. 2 after assembly.

Referring to FIG. 8 and FIG. 9, FIG. 8 illustrates a perspective view of the linkage rod 249 and the resilient connection members 246/248 in FIG. 2 before assembly, and FIG. 9 illustrates a perspective view of the linkage rod 249 and the resilient connection members 246/248 in FIG. 2 after assembly with extension tails 247/247' removed.

As illustrated in FIG. 8, before the resilient connection members 246/248 are assembled to the linkage rod 249, the bottom heads 246*b*/248*b* of the resilient connection members 246/248 have extension tails 247/247'. In this embodiment. the extension tails 247/247' are long cylindrical structures. Because the extension tails 247/247' prolong a total length of the resilient connection members 246/248, it is easier to hold the extension tail 247/247' to force the resilient connection members 246/248 into the internal circular grooves 249*a*'/249*b*' of the sleeves 249*a*/249*b*.

As illustrated in FIG. 9, after the resilient connection members 246/248 are assembled into the sleeves 249*a*/249*b* of the linkage rod 249, the extension tails 247/247' may be cut and removed from the bottom heads 246*b*/248*b* to shorten the total length of the resilient connection members 246/248.

Figure 10:
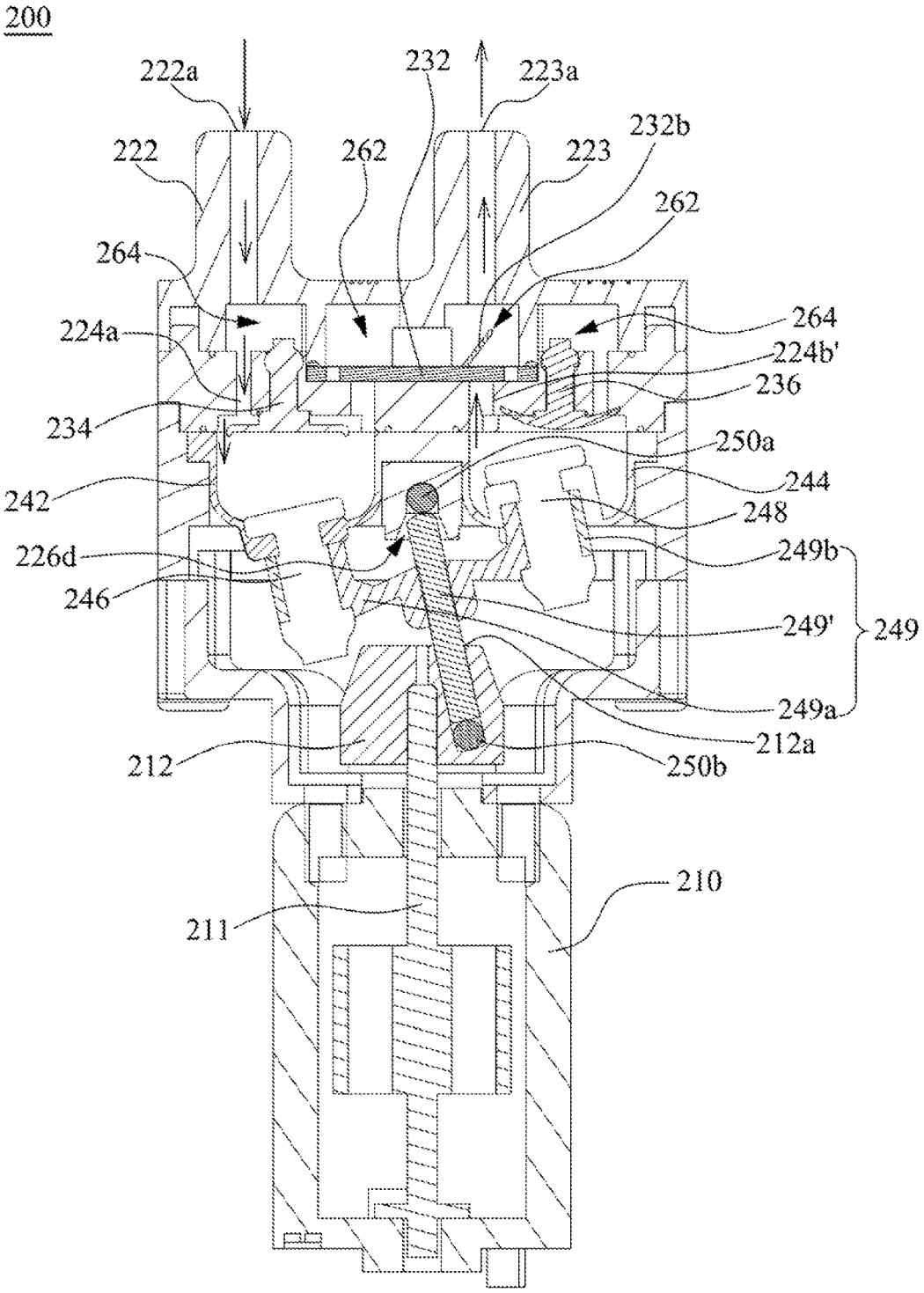
FIG. 10 illustrates a cross-sectional view of the miniature pump in FIG. 2 with its compressible chamber being, decompressed.

FIG. 10 illustrates a cross-sectional view of the miniature pump 200 in FIG. 2 with its compressible chamber being decompressed. When a rotation rod 211 of the motor unit 210 rotates, the rotation rod 211 drives the eccentric shaft portion 212 to rotate simultaneously. The bottom end of the central rod 249' is located within the eccentric hole 212*a* of the eccentric shaft portion 212 such that the linkage rod 249 rotates eccentrically to enable its sleeves 249*a*/249*b* and the resilient connection members 246/248 to be moved up and down. Therefore, the compressible chamber 242 is decompressed and the compressible chamber 244 is compressed as illustrated in FIG. 10.

In this embodiment, the chamber base 226 has a central groove 226*d* , which is funnel-shaped, for the first bearing ball 250*a* to be located, and having a tolerance allowing the central rod 249' to rotate eccentrically. In addition, the eccentric hole 212*a* of the eccentric shaft portion 212 has a second bearing ball 250*b* inside for the bottom end of the central rod 249' to be in contact with. Therefore, when the motor unit 210 drives the eccentric shaft portion 212 to rotate, the linkage rod 249 rotates smoothly together with the eccentric shaft portion 212. The second bearing ball 250*b* also reduces the friction between the central rod 249' and the eccentric shaft portion 212.

As illustrated in FIG. 10, when the compressible chamber 244 is compressed, the air inside the compressible chamber 244 is output via the output passage 224*b*' to enable the valve gate 232*b* of the one-way valve 232 to open (i.e., rises up) such that airflows are routed to an output chamber 262, which is ring-shaped, and then output via the output through hole 223*a* of the output port 223. On the other hand, when the compressible chamber 242 is decompressed, the chamber valve 234 is opened to introduce airflows via the input through hole 222*a* of the passage 222, an input chamber 264, which is also ring-shaped, the input passage 224*a* and the chamber valve 234, and finally into the compressible chamber 242.

Figure 11:
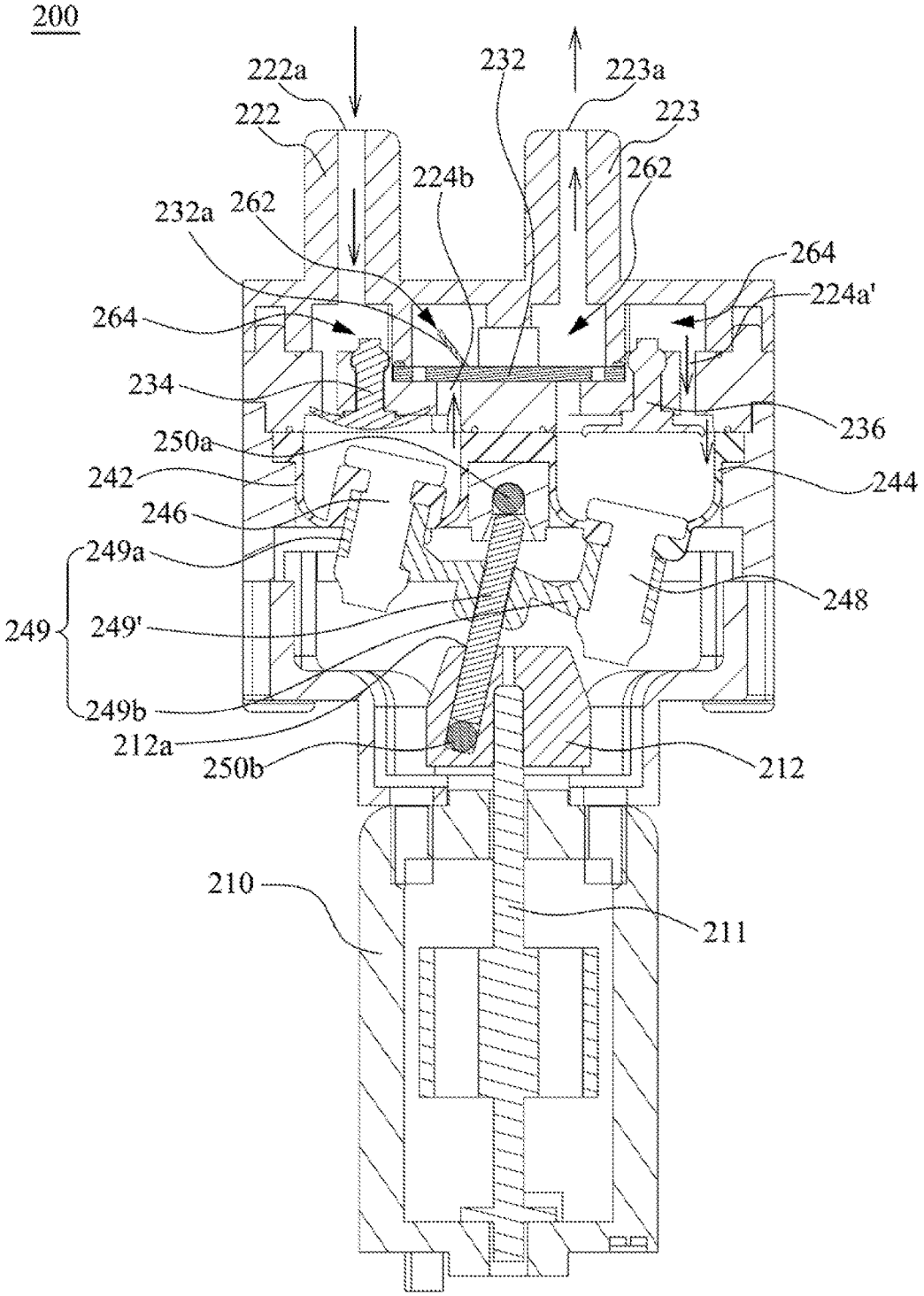
FIG. 11 illustrates a cross-sectional view of the miniature pump in FIG. 2 with its compressible chamber being compressed.

As illustrated in FIG. 11, when the compressible chamber 242 is compressed, the air inside the compressible chamber 242 is output via the output passage 224*b* to enable the valve gate 232*a* of the one-way valve 232 to open (i.e., rises up) such that airflows are routed to an output chamber 262, which is ring-shaped, and then output via the output through hole 223*a* of the output port 223. On the other hand, when the compressible chamber 244 is decompressed, the chamber valve 236 is opened to introduce airflows via the input through hole 222*a* of the passage 222, an input chamber 264, which is also ring-shaped, the input passage 224*a*' and the chamber valve 236, and finally into the compressible chamber 244.

According to the embodiment discussed above, a miniature pump of the present invention has its compressible chamber and resilient connection member made from different materials, and the resilient connection member is made from harder materials. Therefore, when the resilient connection member is coupled with the linkage rod, the resilient connection member is able to compress or decompress the compressible chamber efficiently. The first, second bearing balls are located at two opposite ends of the central rod of the linkage rod to secure the linkage rod stably within the miniature pump, thereby reducing the noises and friction caused by the rotating linkage rod.

Although the present invention has been described in considerable detail with reference to certain embodiments thereof, other embodiments are possible. Therefore, the spirit and scope of the appended claims should not Be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A miniature air pump comprising:

a rotation motor unit;

a valve unit; and a compression unit connected with the rotation motor unit and driven by the rotation motor unit to input or output airflows via the valve unit, wherein the compression unit comprises:

an air chamber module comprising a plurality of compressible chambers and a plurality of resilient connection members, each resilient connection member comprising a sealing head, a bottom head and a rod portion interconnected between the sealing head and the bottom head, wherein each compressible chamber and each resilient connection member are made of different materials, each resilient connection member has a greater material hardness than a material hardness of each compressible chamber, and each compressible chamber has a bottom through hole into which the sealing head of each resilient connection member engages, each compressible chamber has a convex sealing ring disposed around the bottom through hole to be in contact with the sealing head of each resilient connection member, each compressible chamber and the convex sealing ring are made from an elastic rubber material, a maximum outer diameter of the convex sealing ring is smaller than a maximum outer diameter of the sealing head of each resilient connection member; and a linkage rod physically connected with and driven by the rotation motor unit, the linkage rod comprising a central rod and multiple sleeves extending from the central rod, each sleeve having an internal circular groove and a side cutout, wherein a longitudinal direction of the side cutout is in parallel with the central rod, the rod portion of each resilient connection member being slid into the internal circular groove of each sleeve through the side cutout, and each sleeve is sandwiched between the bottom through hole of each compressible chamber and the bottom head of each resilient connection member such that the rotation motor unit drives the air chamber module to be compressed or decompressed so as to input or output airflows via the valve unit.

2. The miniature air pump of claim 1, wherein the rotation motor unit includes an eccentric shaft portion having an eccentric hole into which the central rod is inserted.

3. The miniature air pump of claim 2, wherein the air chamber module further includes a chamber base to secure the compressible chambers, the chamber base has a central groove into which a first beating ball and a top end of the central rod are disposed.

4. The miniature air pump of claim 3, wherein the eccentric hole of the eccentric shaft portion has a second bearing ball with which a bottom end of the central rod is in contact.

5. The miniature air pump of claim 1, wherein a maximum outer diameter of the bottom head is greater than a maximum inner diameter of each sleeve.

6. The miniature air pump of claim 5, wherein a maximum outer diameter of the sealing head is greater than the maximum outer diameter of the bottom head.

* * * * *